United States Patent [19]

Oswald

[11] 4,317,481

[45] Mar. 2, 1982

[54] THERMAL BARRIER

[76] Inventor: Samuel G. Oswald, 1009 Barlow, Traverse City, Mich. 49689

[21] Appl. No.: 111,723

[22] Filed: Jan. 14, 1980

[51] Int. Cl.[3] ..... A47H 5/00; E06B 3/94

[52] U.S. Cl. ..... 160/84 R; 160/DIG. 7

[58] Field of Search ..... 160/84 R, DIG. 7, 166 R, 160/84 R; 428/458, 351

[56] References Cited

U.S. PATENT DOCUMENTS

| | | | |
|---|---|---|---|
| 1,548,523 | 8/1925 | Friend | 160/84 R |
| 1,937,342 | 11/1933 | Higbie | 160/84 R |
| 3,170,714 | 2/1965 | Stalker | 160/84 R |
| 3,487,875 | 1/1970 | Shukat et al. | 160/84 R |
| 3,777,800 | 12/1973 | Susoev | 160/330 |
| 3,967,671 | 7/1976 | Stanley et al. | 160/232 |
| 4,020,826 | 5/1977 | Mole | 160/DIG. 7 |
| 4,037,639 | 7/1977 | Jones | 160/133 |

FOREIGN PATENT DOCUMENTS

| | | | |
|---|---|---|---|
| 866094 | 3/1971 | Canada | 160/DIG. 7 |
| 1067348 | 5/1967 | United Kingdom | 160/84 R |

*Primary Examiner*—C. J. Husar
*Assistant Examiner*—C. S. Lieberman
*Attorney, Agent, or Firm*—Gifford, VanOphem, Sheridan & Sprinkle

[57] ABSTRACT

A unique thermal barrier is provided for use with a window in a building construction. The thermal barrier comprises a sheet at least the same size and preferably somewhat larger than the size of the window and one edge of the sheet is secured to the building above the window. A plurality of slats are secured to one side of the sheet so that the slats extend substantially horizontally and are parallel and adjacent to each other. In addition, the slats are constructed of a thermal insulating material such as a polystyrene foam. A decorative covering is also secured to the sheet so that the slats are positioned in between the decorative covering and the sheet. In addition, a cord is operable to move the sheet with its attached slats between a lower position, in which the sheet covers the window opening, and an upper position in which the slats are folded upon each other thus exposing a substantial portion of the window opening.

8 Claims, 4 Drawing Figures

THERMAL BARRIER

BACKGROUND OF THE INVENTION

I. Field of the Invention

The present invention relates generally to thermal barriers and, more particularly, to a thermal barrier for a window opening.

II. Description of the Prior Art

In homes, office buildings and other types of building constructions, a great deal of heat loss occurs through the windows. This relatively large heat loss is due to the inherent nature of glass which is not a good thermal insulating material. Moreover, with the high cost of fuel for heating such buildings, the loss of heat through the windows has become very expensive.

There have, of course, been a number of previously known measures designed to reduce the heat loss through windows. For example, double and even triple pane glass has been used to reduce the heat loss through the window opening. Double and triple pane glass, however, is very expensive both to install originally in the building and particularly when replacing existing windows. The heat loss through double or triple pane glass, however, is still relatively large.

There have, furthermore, been a number of window coverings designed to provide a thermal barrier between the covering and the window and thus reduce the heat loss through the window. For example, in one thermal barrier of this type, wood is woven together into a tightly knit pattern and hung like a drape across the window opening. Such woven woods, however, are very expensive to manufacture and purchase and yet only marginally reduce the heat loss through the window.

There are still other types of previously known thermal barriers designed to reduce the heat loss through window openings. For example, U.S. Pat. No. 4,037,639 to Jones discloses a thermal barrier in which a plurality of relatively thin slats are pivotally secured together and slidably mounted on a track mounted to both sides of the window. When the barrier is in its lower position, the slats form a dead air space between the barrier and the window thus reducing the heat loss through the window. This type of thermal barrier, however, has not enjoyed wide acceptance or use for a number of different reasons. One reason is that thermal barriers of this type are very difficult to install and, once installed, are unsightly in appearance. Moreover, a relatively high heat loss due to thermal conductance through the thermal barrier still occurs.

SUMMARY OF THE PRESENT INVENTION

The present invention provides a thermal barrier for a window in a building which is highly effective in use, simple to install, decorative in appearance and relatively inexpensive to manufacture.

In brief, the thermal barrier according to the present invention comprises a sheet having one edge secured above the window opening. The sheet is of a size at least as large and preferably somewhat larger than the window opening so that the sheet extends entirely across and from the top and to the bottom of the window. The sheet is flexible and can be made of any conventional material, such as cloth, plastic or the like.

A plurality of relatively wide slats are secured to one side of the sheet so that the slats extend horizontally across the sheet and the lateral edges of adjacent slats are parallel to and closely adjacent each other. The slats are constructed of a thermal insulating material, such as a polystyrene foam, and extend substantially entirely across one side of the sheet. Moreover, the slats are not directly connected to each other and, therefore, can pivot with respect to each other.

A decorative covering is detachably secured to the sheet so that the slats are positioned in between the sheet and decorative covering and thus are hidden from view. The decorative covering is substantially the same size as the sheet and its removability enables it to be removed from the sheet for cleaning or replacement when desired.

A retractor assembly is also connected to the sheet and is operable to move the barrier between an upper and a lower position. In its lower position the thermal barrier extends entirely across the window opening and thus provides a thermal barrier to reduce the heat loss through the window opening. Conversely, in its upper position, the slats are folded one upon the other at the top of the window thus exposing the window when desired.

The thermal barrier according to the present invention is further advantageous in that it is relatively inexpensive to construct. Moreover, detachable fastening means can be used to secure the thermal barrier to the sides of the window when in its lower position in order to further increase its effectiveness.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
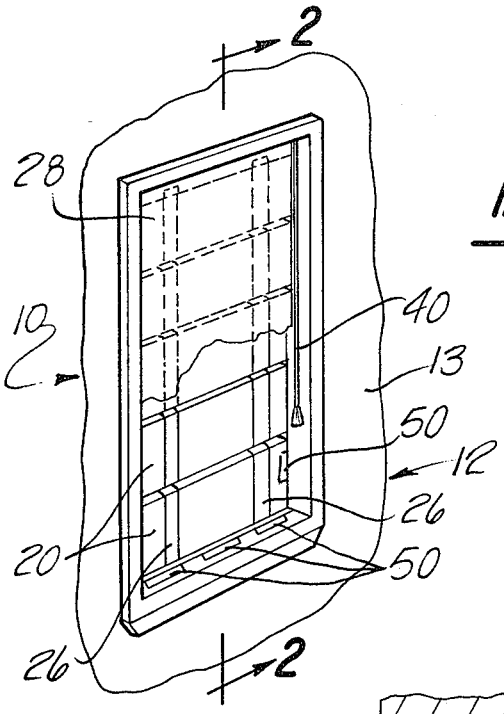
FIG. 1 is a perspective view illustrating a preferred embodiment of the thermal barrier according to the present invention installed in a building.
Figure 2:
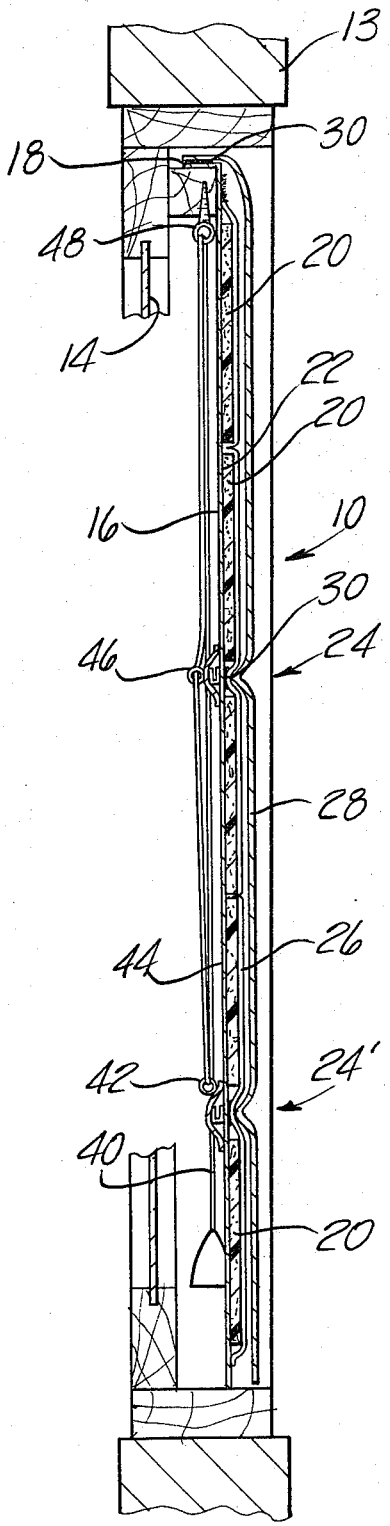
FIG. 2 is a longitudinal sectional view of the thermal barrier of the present invention taken substantially along line 2—2 in FIG. 1 and enlarged for clarity.

With reference first to FIGS. 1 and 2, the thermal barrier 10 according to the present invention is thereshown secured to a wall 13 of a building 12 having a window 14. The building 12 can be any type of building construction, such as a home, office building, or the like.

Still referring to FIGS. 1 and 2, the thermal barrier 10 further comprises a flexible sheet 16 which can be constructed of any conventional material, such as cloth, plastic, or the like. One edge 18 of the sheet is secured to the building 12 above the window 14 so that the upper edge 18 of the sheet protrudes somewhat inwardly from the window 14 as best shown in FIG. 2. Any conventional means can be used to secure the edge 18 of the sheet 16 above the window 14. Moreover, the sheet 16 is at least as large and preferably somewhat larger than the window 14 so that, when in its lower position as viewed in FIGS. 1 and 2, the sheet 16 entirely covers the window 14.

Still referring to FIGS. 1 and 2, a plurality of relatively wide slats 20 are secured to the side 22 of the sheet 16 opposite from the window 14 so that the slats 20 extend generally horizontally across the sheet 16. The lateral edges of each slat 20 are adjacent and parallel to the adjacent slats 20. Moreover, a space 24 of a predetermined width is provided between every other adjacent slat 20 for a reason to be subsequently described. In addition, the slat 20 extends substantially entirely along the entire width and height of the sheet 16.

The slats 20 can be secured to the sheet 16 in any conventional fashion. For example, as illustrated in the drawing, the slats 20 are secured to the sheet 16 by fabric bands 26. Alternatively, the slats 20 can be glued or otherwise secured directly to the sheet 16 thus eliminating the need for the bands 26.

The slats 20 furthermore are constructed of a thermal insulating material. In the preferred form of the invention, the slats 20 are constructed of a polystyrene foam, commonly available under the trademark STYROFOAM although other types of insulating material can also be used. In addition, the slats 20 are of a predetermined thickness which is substantially one-half (½) the width of the space 24 also for a reason to be subsequently described.

Still referring to FIGS. 1 and 2, a decorative covering 28 is detachably secured to the sheet 16 by fastening means 30. The decorative covering 28 is substantially the same size as the sheet 16 and is secured to the sheet 16 so that the slats 20 are positioned in between the covering 28 and the sheet 16 and are thus hidden from view. In the preferred form of the invention, the fastening means 30 is a detachable fastening means, such as a loop and pile fastener, so that the decorative covering 28 can be removed from the sheet 16 when desired for cleaning without removing the sheet 16 from the building wall 13. The detachable connection of the decorative covering 28 to the sheet 16 also enables different decorative coverings 28 to be secured to the thermal barrier 10 with a minimum of difficulty and cost when a decorative change for the thermal barrier 10 is desired.

As best shown in FIG. 2, if desired, the fastening means 30 can also be provided along the length of the decorative covering 28 and the sheet 16, i. e. between the slats 20, in order to provide a folded appearance for the sheet 28 and thus for the thermal barrier 10. Moreover, the fastening means 30 can also be provided along the vertically extending edges of the sheet 16 and decorative covering 18 if desired.

Figure 4:
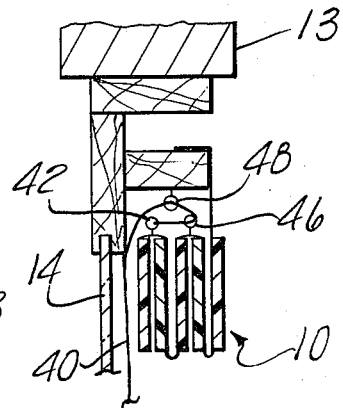
FIG. 4 is a fragmentary side view illustrating the thermal barrier in its upper position and with parts removed for clarity.

Referring now to FIGS. 1–4, the thermal barrier 10 according to the present invention further includes means for moving the thermal barrier between a lower and an upper position. In its lower position, as shown in FIGS. 1 and 2, the thermal barrier 10 extends across and covers the window opening 14 thus reducing the heat loss through the window 14 due to the slats 20 which are constructed of the thermal insulating material. Conversely, in its upper position as shown in FIG. 4, the slats 20 are folded one upon the other and maintained near the top of the window thus exposing substantially all of the window 4.

Figure 3:
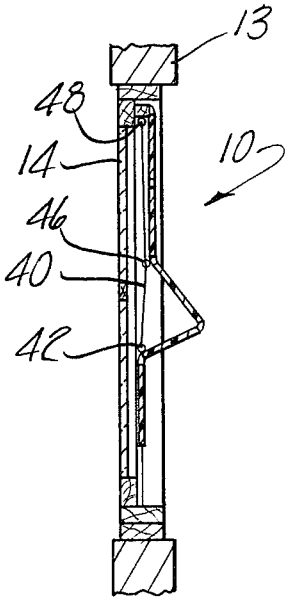
FIG. 3 is a side view illustrating the movement of the thermal barrier from its lower and to its upper position and with parts removed for clarity.

The means for moving the thermal barrier 10 between its upper and lower position is best shown in FIGS. 2–4 in which at least one and preferably several cords 40 which are secured at one end 42 to the other side 44 of the sheet 16 opposite from the lowermost space 24' between the slats 20. Each cord 40 extends vertically upwardly along the side 44 of the sheet 16 and is slidably connected to the sheet 16 by rings 46 (one of which is shown) at points aligned with the open spaces 24 between the slats 20 along the length of the thermal barrier 10. The cords 40 are furthermore slidably connected by rings 48 secured to the building 12 above the window 14 and the cords 40 extend outwardly from one side of the window 14 as best shown in FIG. 1.

As best shown in FIG. 3, as the cords 40 are drawn outwardly from the window, the slats 20 between the lower end 42 of the cord 40 and the next higher ring 46 protrude outwardly from the window and fold upon each other. Likewise, further extension of the cords 40 from the window continue to fold the slat 20 one upon the other so that, as shown in FIG. 4, with the thermal barrier 10 in its uppermost position, the slats 20 are all folded upon each other and positioned at the upper end of the window 14. In this position, the slats 20 hang downwardly from the top of the window 14. Moreover, since most windows are recessed into the wall 13, the thermal barrier 10, in its upper position, is conveniently positioned within the window recess. Moreover, the spaces 24 between every other slat 20 enable the slats 20 to flatly fold one upon each other as shown in FIG. 4 since each space 24 has a width substantially twice the thickness of the slats 20.

Alternatively, if a valance is used with the window 14, the upper edge 18 of the sheet can be secured behind the valance so that, when moved to its upper position, the thermal barrier 10 is positioned behind the valance and hidden from view.

Referring now to FIG. 1, if desired, a detachable fastener 50 (illustrated only diagramatically), such as a loop and pile fastener, can be operatively positioned between the sides and/or bottom of the thermal barrier 10 and around the sides of the window 14. With the thermal barrier 10 in its lower position, the fastening means 50 would enable a tight seal to be established between the thermal barrier 10 and the sides of the window 14 thus further enhancing the thermal insulating properties of the thermal barrier 10.

From the foregoing, it can be seen that the thermal barrier 10 according to the present invention provides a thermal barrier for a window which is highly effective in operation and yet relatively inexpensive in construction. The thermal barrier 10 is further advantageous in that the decorative covering 28 can be easily removed when desired for cleaning or replacement and, when attached to the sheet 16, provides a highly desirable decorative appearance for the thermal barrier 10.

It will be understood, however, that the foregoing description is by way of example only and that no undue limitation should be drawn therefrom.

For example, although the slats have been described and illustrated as being secured to one side of the sheet 16, alternatively the slats can be pivotally connected together by securing fabric strips to adjacent slats on alternating sides of the slats. Likewise, although the decorative covering has been described as a single fabric piece, it can be segmented, as desired, into horizontal or vertical strips in order to present a "layered" appearance.

Having thus described my invention, still further modifications will become apparent to those skilled in the art to which it pertains without deviation from the spirit of the invention as defined by the scope of the appended claims.

I claim:

1. For use in conjunction with a building having a window oriented in substantially a vertical plane, a thermal barrier comprising:

a flexible sheet having substantially the same shape and size as the window, a plurality of rigid, elongated and rectangular slats, said slats being constructed of a synthetic thermal insulating material;

means for securing said slats to one side of said sheet so that said slats extend horizontally across said assembly, the longitudinal edges of each slat being parallel to and adjacent the longitudinal edges of the adjacent slats, said sheet and said slats forming an assembly in which the sheet hingedly secures the adjacent edges of adjacent slats together;

means for attaching an upper edge of the assembly to the building above the window at a position spaced from said window by an amount at least as great as the combined thicknesses of said slats, means for moving said assembly between a lower position and an upper position so that in said lower position, said assembly is positioned substantially entirely across said window so that said side of said sheet faces away from the window and so that in said upper position, said slats are stacked upon each other to thereby expose substantially all of the window; and wherein the lower longitudinal edge of every other slat is spaced upwardly from the upper longitudinal edge of the next lower slat to thereby form a horizontally extending open space therebetween and wherein said moving means further comprises a cord secured at one end to the other side of said sheet opposite from the lowermost open space, said cord being slidably attached to the other side of said sheet opposite from every other open space, and means for slidably attaching said cord to said building above said window so that when said assembly is in its upper position, said slats lie substantially in a vertical plane and are stacked between the window and said upper edge of the assembly.

2. The invention as defined in claim 1 wherein said thermal insulating material is a polystyrene foam.

3. The invention as defined in claim 1 and further comprising means for detachably securing said assembly to said building along the periphery of the window.

4. The invention as defined in claim 3 wherein said detachable securing means comprises a loop and pile fastening means.

5. The invention as defined in claim 1 and further comprising a decorative cover secured to said sheet so that said slats are positioned in between said cover and said sheet.

6. The invention as defined in claim 1 and further comprising a decorative cover secured across said slots on the side remote from said sheet.

7. The invention as defined in claim 6 and further comprising means for detachably securing said decorative cover to said assembly.

8. The invention as defined in claim 7 wherein said detachable securing means comprises a loop and pile fastening means.

* * * * *